United States Patent [19]

Pinson

[11] Patent Number: 4,709,876

[45] Date of Patent: Dec. 1, 1987

[54] PNEUMATIC MISSILE SEEKER HEAD

[75] Inventor: George T. Pinson, Huntsville, Ala.

[73] Assignee: The Boeing Company, Seattle, Wash.

[21] Appl. No.: 726,670

[22] Filed: Apr. 24, 1985

[51] Int. Cl.[4] ..... F42B 15/02

[52] U.S. Cl. ..... 244/3.16

[58] Field of Search ..... 244/3.16, 3.15, 3.19

[56] References Cited

U.S. PATENT DOCUMENTS 3,064,924 11/1962 Fairbanks ..... 244/3.16

4,105,174 8/1978 Blomquist et al. ..... 244/3.16

4,158,845 6/1979 Pinson ..... 244/3.16

4,415,130 11/1983 Staehlin ..... 244/3.15

*Primary Examiner*—Charles T. Jordan

[57] ABSTRACT

A pneumatic missile seeker head for moving in all directions about a rotational axis in response to commands from a control system. The seeker head scanning, in a controlled pattern, an area being searched by a signal or target detector. Upon locating the target, the head is able to move in a manner that permits the detector to continually track the target.

6 Claims, 8 Drawing Figures

PNEUMATIC MISSILE SEEKER HEAD

BACKGROUND OF THE INVENTION

This invention relates to a pneumatic seeker head and more particularly, but not by way of limitation, for use with missile and aircraft applications for scanning in a controlled pattern an area being searched by a signal or target detector.

Heretofore, there have been various types of seeker heads and tracking antennas described in the following U.S. Pat. Nos. 2,654,031 to Mullins, Jr., et al, 2,786,361 to Russell, 2,762,234 to Dodd, 3,238,739 to Webb, 3,487,277 to Walters, 3,987,452 to Godet and 4,197,548 to Smith et al. None of the above-mentioned patented devices provide the unique features and advantages of the subject pneumatic seeker head used for searching a target area in a controlled pattern.

SUMMARY OF THE INVENTION

This invention provides a pneumatic missile seeker head which can scan in a controlled pattern an area being searched by a signal or target detector. Upon acquisition of the target, the seeker head can move in any manner that allows for continuous tracking of the target by the target detector.

Through the use of pneumatic actuators having eccentric drive cams for rotating a primary receiving or transmitting element, the actuators are strong enough to allow a spider with secondary elements to be attached to the primary element. This permits an axis optical performance to be maintained throughout the entire angular operating range of the seeker head.

The pneumatic missile seeker head for moving about a rotational axis in response to commands from a control system include a primary optical element for receiving signal information thereon. The primary optical element is mounted on a flexible ball or "O" ring joint. A plurality of pneumatic actuators are attached to a mounting plate. The actuators have drive cams which engage the primary optical element for moving the optical surface of the primary element about the ball joint. As an option a spider may be attached to the front of the primary element with a secondary optical element mounted thereon.

The advantages and objects of the invention will become evident from the following detailed description of the drawings when read in connection with the accompanying drawings which illustrate preferred embodiments of the invention.

BRIEF DESCRIPTION OF THE DRAWINGS

FIG. 5 illustrates an alternate embodiment of the pneumatic seeker head.

FIG. 6 illustrates an alternate embodiment of the pneumatic actuator used in driving the seeker head.

DETAILED DESCRIPTION OF THE DRAWINGS

Figure 1:
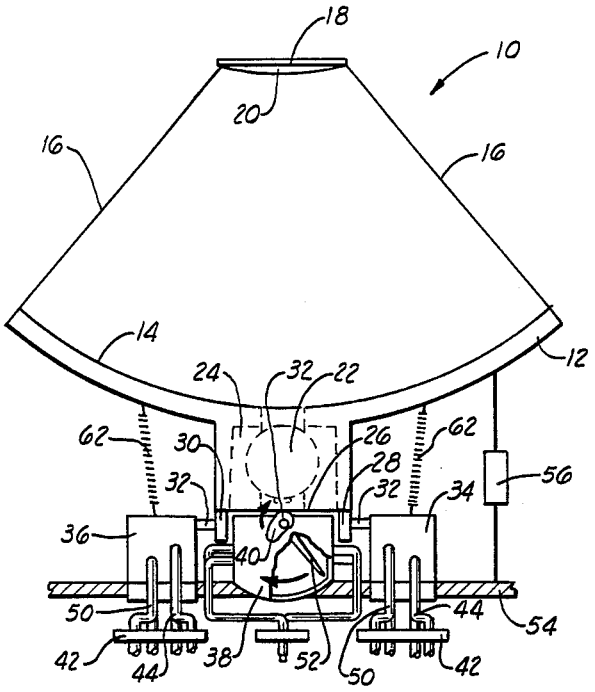
FIG. 1 illustrates a side view of the pneumatic seeker head.

In FIG. 1 the pneumatic missile seeker head is designated by general reference numeral 10. The seeker head includes a primary optical element 12 having a concave optical mirror surface 14 for receiving signals and target information thereon. Extending outwardly and attached to the front of the primary optical element 12 is a spider 16 used for receiving a secondary optical element 18 having an optical surface 20 thereon. The spider 16 and secondary optical element 18 are optional structure for use with the missile seeker head 10. But, it should be noted that the seeker head 10, by the nature of its structure permits the use of the secondary optical element 18 for improved optical performance, or the structure can be replaced by a refractive telescope.

The seeker head 10 further includes the primary optical element 12 mounted on a flexible ball or "O" ring joint 22. Integrally formed at the rear of the primary optical element 12 is a ball joint housing 24 for receiving the ball joint 22 therearound. The housing 24 includes a flat drive cam surface 26 which is used for engaging a first drive cam 28 and a second drive cam 30. The cams 28 and 30 are attached to drive shafts 32 received inside a first pneumatic actuator 34 and a second pneumatic actuator 36. Also shown in FIG. 1 is a third pneumatic actuator 38 having a drive shaft 32 attached to a third drive cam 40 which also engages the drive cam surface 26. The actuators 34, 36 and 38 are all connected to a pressure manifold 42 for supplying a high pressure gas to fill lines 44. Each of the actuators is divided into two separate pressure chambers 46 and 48 shown in FIGS. 4, 5 and 6. Each chamber has a fill line 44 and an exhaust line 50. As high pressure gas is introduced in the chamber a movable vane 52 rotates the drive shaft 32 which in turn rotates the eccentric drive cam 28 against the cam surface thereby rotating the element 12 on the ball joint in a desired scanning pattern. It should be noted that a minimum of two pneumatic actuators must be used and placed orthogonally on a mounting plate 54 shown in FIG. 1, additional actuators may be used in a spaced relationship on the mounting plate 54 for engaging the drive cam surface 26.

Figure 2A:
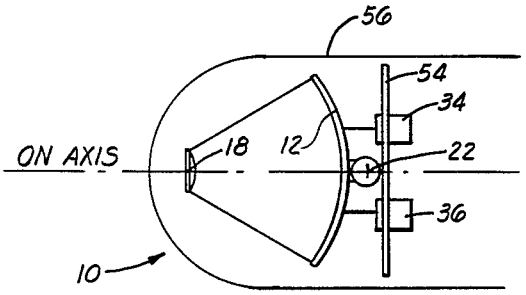
FIG. 2A and FIG. 2B illustrate the seeker head mounted in the dome of a missile with the primary and secondary optical elements on axis and off axis.
Figure 2B:
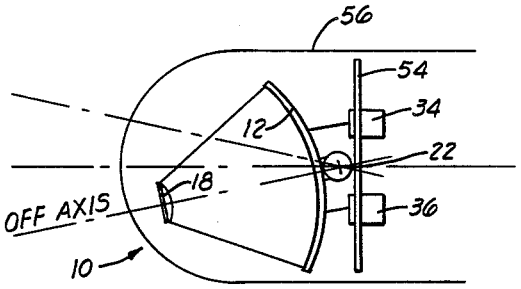

In FIG. 2A the seeker head 10 is shown with the spider 16 and secondary optical element 18 aligned on axis and disposed in a dome 56 of a missile. FIG. 2B illustrates the seeker head 10 off axis. Through the use of the pneumatic actuators, the seeker head 10 is strong enough to permit both the spider 16 and secondary optical element 18 to be attached to the primary optical element 12 thereby permitting on axis optical performance to be maintained throughout the entire angular operating range of the seeker head 10.

Figure 3:
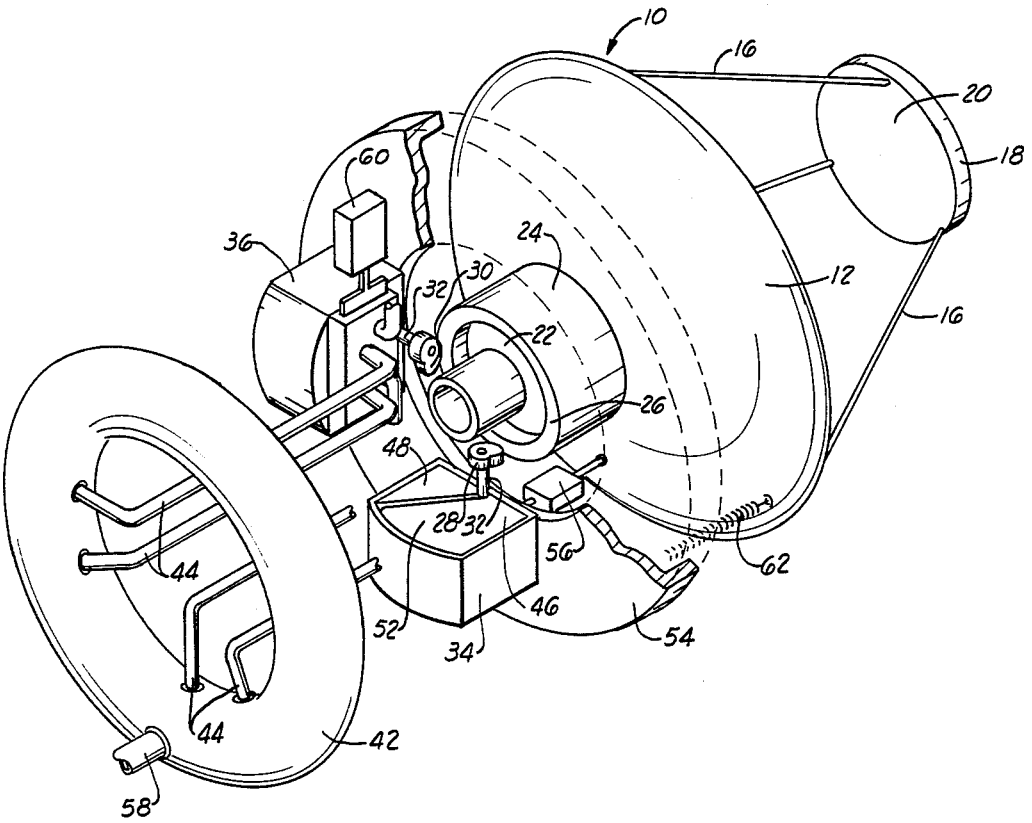
FIG. 3 illustrates a perspective view of the pneumatic seeker head.

In FIG. 3 a perspective view of the seeker head 10 is illustrated. In this view, the secondary element 18 is attached to the rigid spider 16 which is in turn rigidly attached to the primary reflector 12. The rear of the ball joint 22 is attached to the mounting plate 54. The position of the primary reflector 12 relative to the mounting plate 54 is continuously monitored by a head feedback device 56 attached thereto which may be a potentiometer or a LED position measuring device.

The high pressure gas is supplied from a gas supply line 58 to the pressure manifold 42. Individual valves 60 attached to the lines 44 and 50 control the supply of gas to the pneumatic actuators. The pressurized gas is admitted to one of the two chambers simultaneously with gas vented through the exhaust line 50 from the opposite chamber. Motion of the vane 52 attached to the drive shaft cam 32 in turn rotates each of the cams. The movement of the cams against the cam bearing surface focuses the primary reflector 12 on a selected target as it rotates about the ball joint 22. Tension springs 62 attached to the mounting plate 54 and primary reflector 12 provide a restoring force to the optical system if required.

Figure 4A:
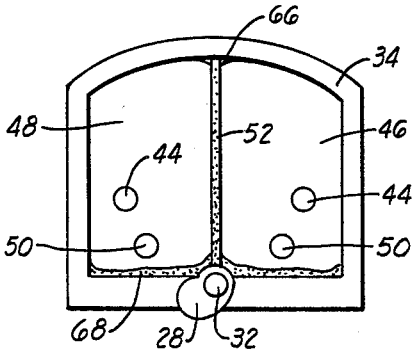
FIGS. 4A and 4B illustrate a front and side view of a pneumatic actuator.
Figure 4B:
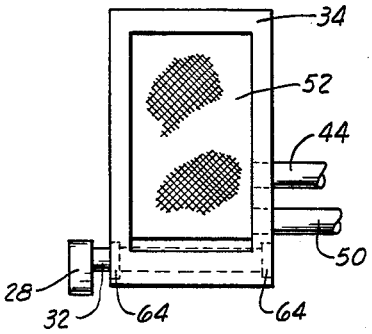
Figure 3:
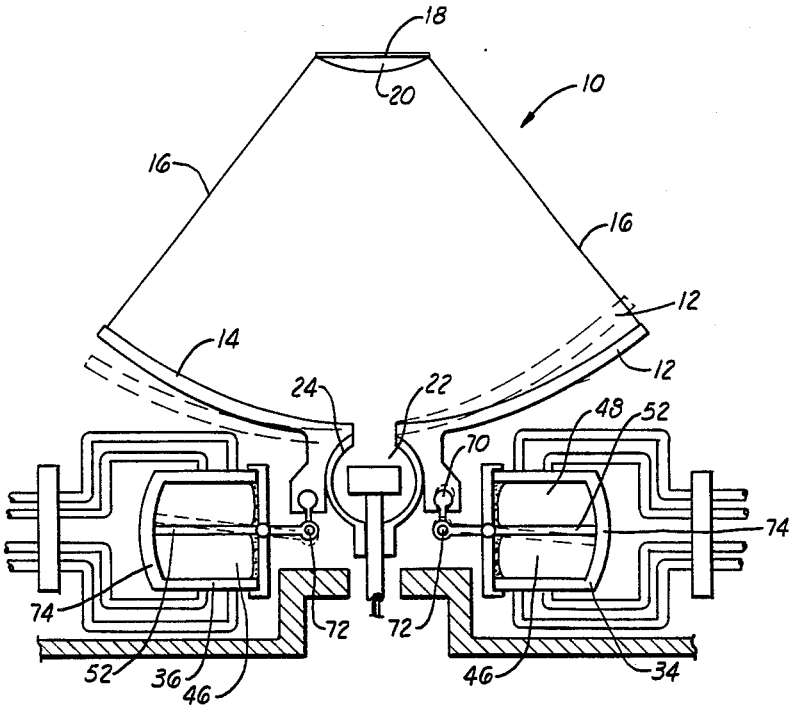
Figure 4:
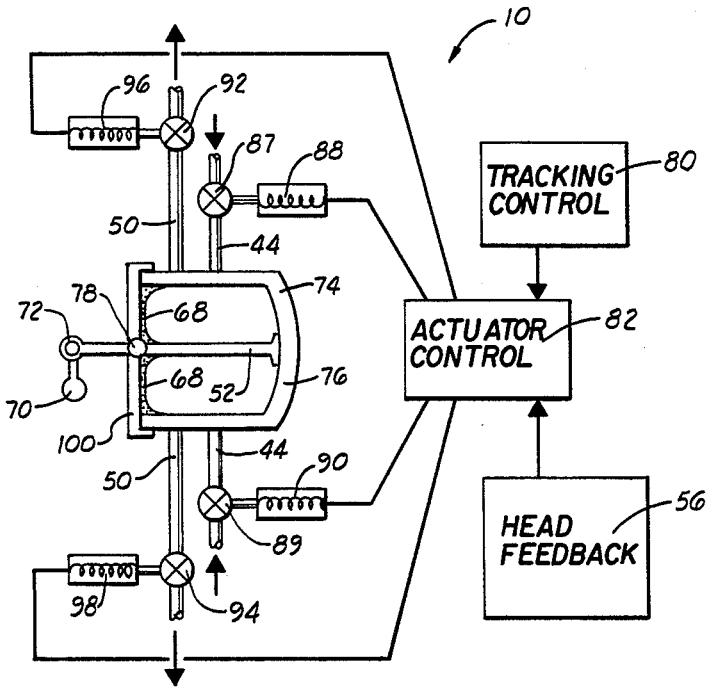

Shown in FIGS. 4A and 4B, the actuator 34 can be seen with the vane 52 being forced by differential pressure rotating the individual drive shaft 32. Bearings 64 are provided to prevent binding of the shaft 32. Gas seals for the actuator 34 are provided through the use of a flexible skirt 66 and flap seal 68.

An alternate embodiment of the seeker 10 is shown in FIG. 5. In this illustration, the primary difference is the primary reflector 12 is acted upon by actuators using, instead of a rotating cam, a lever 70 which is in the form of a snap-joint, is attached to a hinge 72. A drive actuator 74 as shown in FIG. 6 includes a pressure case 76, a movable vane 52, a flap seal 68, "O" rings 78, along with the hinge 72 and snap-joint lever 70.

The position of the primary reflector 12 is commanded by a tracking control system 80 connected to an actuator control system 82. The head position is provided by the feedback device 56. The actuator control system 82 controls the individual actuators 74. This actuator 74 is the same as the actuators 34 and 36 shown in FIG. 3. High pressure gas is admitted into either of the two chambers by opening valves 87 and 89 controlled by valve actuators 88 and 90. At the same time, opposite exhaust valves 92 and 94 controlled by valve actuators 96 and 98 are opened to reduce the pressure in the opposing chamber.

The high pressure gas in the chambers causes the movable vane 52 to rotate about hinge 72. This motion causes the snap-joint lever 70 to push against the optical primary surface 12. Note that the snap-joint lever 70 is basically a ball joint but can be a fixture rigidly attached to a movable element of the primary element 12. Sealing of the chambers in each actuator is provided by a flap seal 68. This seal 68 is attached to the movable vane 52 in a pressure proof manner. The flap seal 68 is made of a pliable material which is feathered such that the pressure aides in producing a gas type seal in each of the chambers. The flap seal 68 may be attached to the chamber and to an end cap 100 by a suitable adhesive.

The O-ring seal 78 is provided on the end cap 100 for additional protection against leakage. The seal between the movable vane 52 and the pressure chamber is enhanced by a feathered flexible skirt 66 attached to the end of the movable vane 52.

Changes may be made in the construction and arrangement of the parts or elements of the embodiments as described herein without departing from the spirit or scope of the invention defined in the following claims.

What is claimed is:

1. A pneumatic seeker head for moving about a rotational axis in response to a command from a control system, the seeker head scanning an area searched by a target detector, the seeker head comprising:

a primary optical element for receiving signal information thereon, the element mounted on a flexible ball joint;

a first pneumatic actuator attached to a mounting plate, the first actuator having a first eccentric means for engaging and rotating the primary optical element on the ball joint; and a second pneumatic actuator attached to the mounting plate, the second actuator having a second eccentric means for engaging and rotating the primary optical element on the ball joint; and a high pressure gas source for supplying high pressure gas to the pneumatic actuators.

2. The seeker head as described in claim 1 wherein the first and second eccentric means are drive cams having cam drive shafts attached to the pneumatic actuators.

3. The seeker head as described in claim 1 further including a head feedback device attached to the mounting plate and the primary optical element for providing position feedback to the control system.

4. The seeker head as described in claim 1 further including tension springs attached to the rear of the primary optical surface and the mounting plate for providing a restoring force for returning the primary optical element to its original position.

5. A pneumatic seeker head for moving about a rotational axis in response to a command from a control system, the seeker head scanning an area searched by a target detector, the seeker head comprising:

a primary optical element for scanning the area searched by the target detector and for receiving signal information thereon, the element mounted on a flexible ball joint;

a first pneumatic actuator attached to a mounting plate, the first actuator having a first drive cam attached thereto for engaging and rotating the primary optical element on the ball joint;

a second pneumatic actuator attached to the mounting plate, the actuator having a second drive cam attached thereto for engaging and rotating the primary optical element on the ball joint;

fill and exhaust lines attached to the first and second pneumatic actuators;

a high pressure gas source attached to the fill lines for providing high pressure gas to the pneumatic actuators; and a head feedback device attached to the primary optical element and the mounting plate for providing position feedback to the control system.

6. The seeker head as described in claim 5 further including a third pneumatic actuator attached to the mounting plate, the third actuator having a third drive cam attached thereto for engaging and rotating the primary optical element on the ball joint.

* * * * *